US008196605B2

(12) United States Patent
Akiyama

(10) Patent No.: US 8,196,605 B2
(45) Date of Patent: Jun. 12, 2012

(54) AIR INTAKE DEVICE FOR ENGINE

(75) Inventor: Hiroshige Akiyama, Miyagi (JP)

(73) Assignee: Keihin Corporation, Tokyo (JP)

( * ) Notice: Subject to any disclaimer, the term of this patent is extended or adjusted under 35 U.S.C. 154(b) by 597 days.

(21) Appl. No.: 12/065,474

(22) PCT Filed: Aug. 16, 2006

(86) PCT No.: PCT/JP2006/316094

§ 371 (c)(1),
(2), (4) Date: Aug. 24, 2009

(87) PCT Pub. No.: WO2007/029460

PCT Pub. Date: Mar. 15, 2007

(65) Prior Publication Data

US 2009/0301569 A1 Dec. 10, 2009

(30) Foreign Application Priority Data

Sep. 6, 2005 (JP) ..... 2005 258140

(51) Int. Cl.
*F02D 3/00* (2006.01)

(52) U.S. Cl. ..... 137/601.18; 137/601.17; 137/301.14; 123/339.24

(58) Field of Classification Search ..... 123/339.22–339.27; 137/599.11, 137/601.14, 601.17, 601.18
See application file for complete search history.

(56) References Cited

U.S. PATENT DOCUMENTS 4,378,767 A * 4/1983 Kobashi et al. ..... 123/339.26
4,438,049 A * 3/1984 Ammons ..... 261/42
4,823,750 A * 4/1989 Niida et al. ..... 123/339.28
5,497,746 A * 3/1996 Semence et al. ..... 123/339.27
2006/0065238 A1 * 3/2006 Kure ..... 123/339.24

FOREIGN PATENT DOCUMENTS

| | | | |
|---|---|---|---|
| JP | 1-92564 | U | 6/1989 |
| JP | 2002-349396 | A | 12/2002 |
| JP | 2003-74444 | A | 3/2003 |
| JP | 2003-343398 | A | 12/2003 |
| JP | 2004-183523 | A | 7/2004 |
| JP | 2005-54775 | A | 3/2005 |
| WO | WO 01/98644 | A1 | 12/2001 |

* cited by examiner

*Primary Examiner* — John Rivell
*Assistant Examiner* — R. K. Arundale
(74) *Attorney, Agent, or Firm* — Arent Fox LLP

(57) ABSTRACT

An air intake device for an engine is provided in which a bypass valve (V) is formed from a tubular valve chamber (15) having its interior opening on the upstream side of a bypass (20) and having an inner face with a metering hole (16) opening toward the downstream side of the bypass (20), and a valve body (25) that is slidably but non-rotatably fitted into the valve chamber (15) and that opens and closes the metering hole (16), wherein the valve chamber (15) and the metering hole (16) are formed in a bypass valve holder (10) provided so as to be connected to a throttle body (1), and a dividing wall (17) that divides the metering hole (16) into a plurality of small metering holes (16*a*, 16*b*) arranged in the peripheral direction of the valve chamber (15) is formed in the bypass valve holder (10) so as to be continuous with an inner peripheral face of the valve chamber (15). This can prevent any hindrance to the closing movement of the valve body of the bypass valve even when a large metering hole is employed.

4 Claims, 10 Drawing Sheets

AIR INTAKE DEVICE FOR ENGINE

CROSS-REFERENCE TO RELATED APPLICATION

This application is a National Stage entry of International Application No. PCT/JP2006/316094, filed Aug. 16, 2006, the entire specification claims and drawings of which are incorporated herewith by reference.

TECHNICAL FIELD

The present invention relates to an improvement of an air intake device for an engine, the air intake device including a throttle body having an air intake path, a throttle valve that is supported on the throttle body and that opens and closes the air intake path, a bypass connected to the air intake path while bypassing the throttle valve, and a bypass valve for controlling the degree of opening of the bypass, the bypass valve being formed from a tubular valve chamber having an interior thereof opening on the upstream side of the bypass and having an inner face with a metering hole opening toward the downstream side of the bypass, and a valve body that is slidably but non-rotatably fitted into the valve chamber and that opens and closes the metering hole, at least part of the downstream side of the bypass extending from the metering hole being formed so as to cross a sliding direction of the valve body.

BACKGROUND ART

Such an air intake device for an engine is already known, as disclosed in Patent Publication 1.

[Patent Publication 1] Japanese Patent Application Laid-open No. 2003-74444

DISCLOSURE OF INVENTION

Problems to be Solved by the Invention

In recent years, accompanying an increase in the output of engines mounted in automobiles and motorcycles, there is a requirement for a high flow rate of fast idle air, and there is therefore a trend towards enlargement of a metering hole that is controlled so as to open and close by a bypass valve.

However, in the case of a large metering hole, when the valve body is drawn to the metering hole side by engine air intake negative pressure, there is a possibility of an end part of the valve body being forced out toward the metering hole, thus preventing a smooth opening and closing movement of the valve body.

The present invention has been accomplished in the light of such circumstances, and it is an object thereof to provide an air intake device for an engine of the above type that can prevent any hindrance to the closing movement of the valve body even when a large metering hole is employed.

Means for Solving the Problems

In order to attain the above object, according to a first aspect of the present invention, there is provided an air intake device for an engine, comprising a throttle body having an air intake path, a throttle valve that is supported on the throttle body and that opens and closes the air intake path, a bypass connected to the air intake path while bypassing the throttle valve, and a bypass valve for controlling the degree of opening of the bypass, the bypass valve being formed from a tubular valve chamber having an interior thereof opening on the upstream side of the bypass and having an inner face with a metering hole opening toward the downstream side of the bypass, and a valve body that is slidably but non-rotatably fitted into the valve chamber and that opens and closes the metering hole, at least part of the downstream side of the bypass extending from the metering hole being formed so as to cross a sliding direction of the valve body, characterized in that the bypass is a single bypass, the tubular valve chamber, the metering hole and at least part of the downstream side of the bypass are formed in a bypass valve holder provided so as to be connected to the throttle body, a dividing wall that divides the metering hole into a plurality of small metering holes arranged in the peripheral direction of the valve chamber is formed in the bypass valve holder so as to be continuous with an inner peripheral face of the valve chamber, and the plurality of small metering holes communicate with a single passage forming the downstream side of the bypass.

According to a second aspect of the present invention, in addition to the first aspect, the small metering holes are each formed as a rectangle having two sides parallel to a sliding direction of the valve body.

According to a third aspect of the present invention, in addition to the first or second aspect, the valve body is given a normal idle adjustment stroke for moving from a fully closed position thereof to a position at which the metering holes start to open, the valve body is provided with a slit for providing communication between the valve chamber and at least one of the small metering holes, and the slit is formed so that the area of the slit opening to the small metering hole increases as the valve body moves through the normal idle adjustment stroke from the fully closed position.

According to a fourth aspect of the present invention, in addition to the third aspect, the small metering hole in which the slit opens is positioned on the upstream side, relative to the other small metering hole, of the bypass, and a labyrinth wall is provided so as to be connected to the dividing wall, the labyrinth wall trapping carbon flowing backward in the bypass and preventing carbon from entering the small metering hole in which the slit opens.

Effects of the Invention

In accordance with the first aspect of the present invention, even when the valve body is drawn toward the plurality of small metering holes due to engine air intake negative pressure, since the valve body is supported by the dividing wall between the small metering holes, it is possible to prevent the end part of the valve body from being forced out toward the small metering hole, thereby enabling the valve body to always open and close well. This enables the small metering holes to be enlarged so that they can match a higher output for the engine.

In accordance with the second aspect of the present invention, it is possible to control a large fast idle air volume and to make the fast idle air volume linearly proportional to the stroke of the valve body.

In accordance with the third aspect of the present invention, since, before the valve body opens the small metering holes, the area of the slit of the valve body opening to the small metering hole increases in response to movement through the normal idle adjustment stroke from the fully closed position, it is possible to easily carry out fine adjustment of the normal idle air volume by movement of the valve body within the normal idle adjustment stroke.

In accordance with the fourth aspect of the present invention, even when blow back gas from the engine flows backward in the bypass, carbon contained in the gas can be trapped in the labyrinth wall, thus preventing carbon from entering the small metering hole, in which the slit opens, and it is therefore possible to prevent the slit from being blocked by carbon, thereby stabilizing the adjusted normal idle air volume and consequently stabilizing engine idling.

EXPLANATION OF REFERENCE NUMERALS AND SYMBOLS

Figure 1:
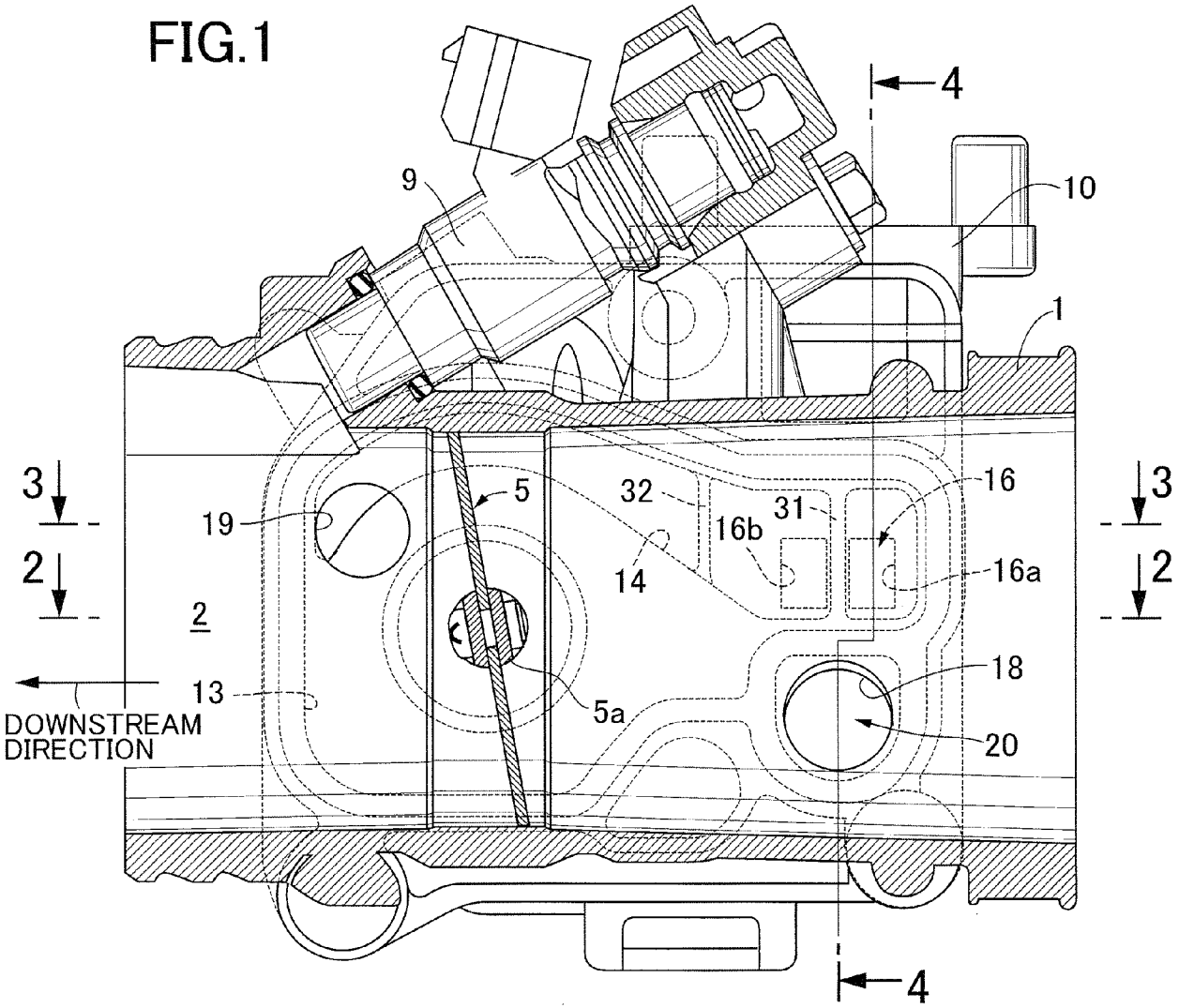
FIG. 1 is a sectional side view of an air intake device for an engine, related to the present invention (first embodiment).

S Normal idle adjustment stroke
V Bypass valve
1 Throttle body
2 Air intake path
5 Throttle valve
10 Bypass valve holder
15 Valve chamber
16 Metering hole
16*a*, 16*b* Small metering hole
20 Bypass
25 Valve body
31 Labyrinth wall
33 Slit

BEST MODE FOR CARRYING OUT THE INVENTION

Modes for carrying out the present invention are explained below by reference to a preferred embodiment of the present invention shown in the attached drawings.

Embodiment 1

Figure 2:
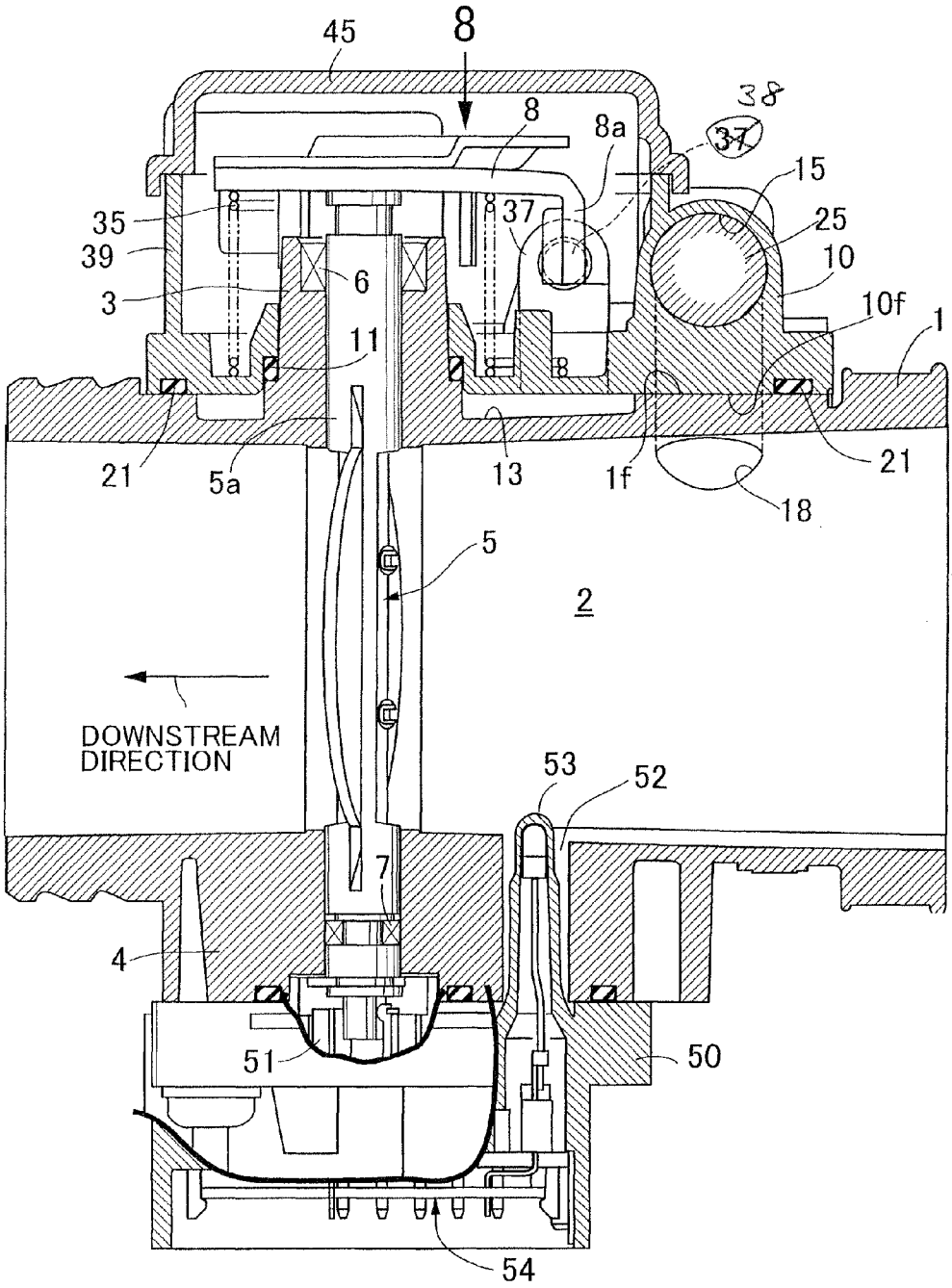
FIG. 2 is a sectional view along line 2-2 in FIG. 1 (first embodiment).
Figure 3:
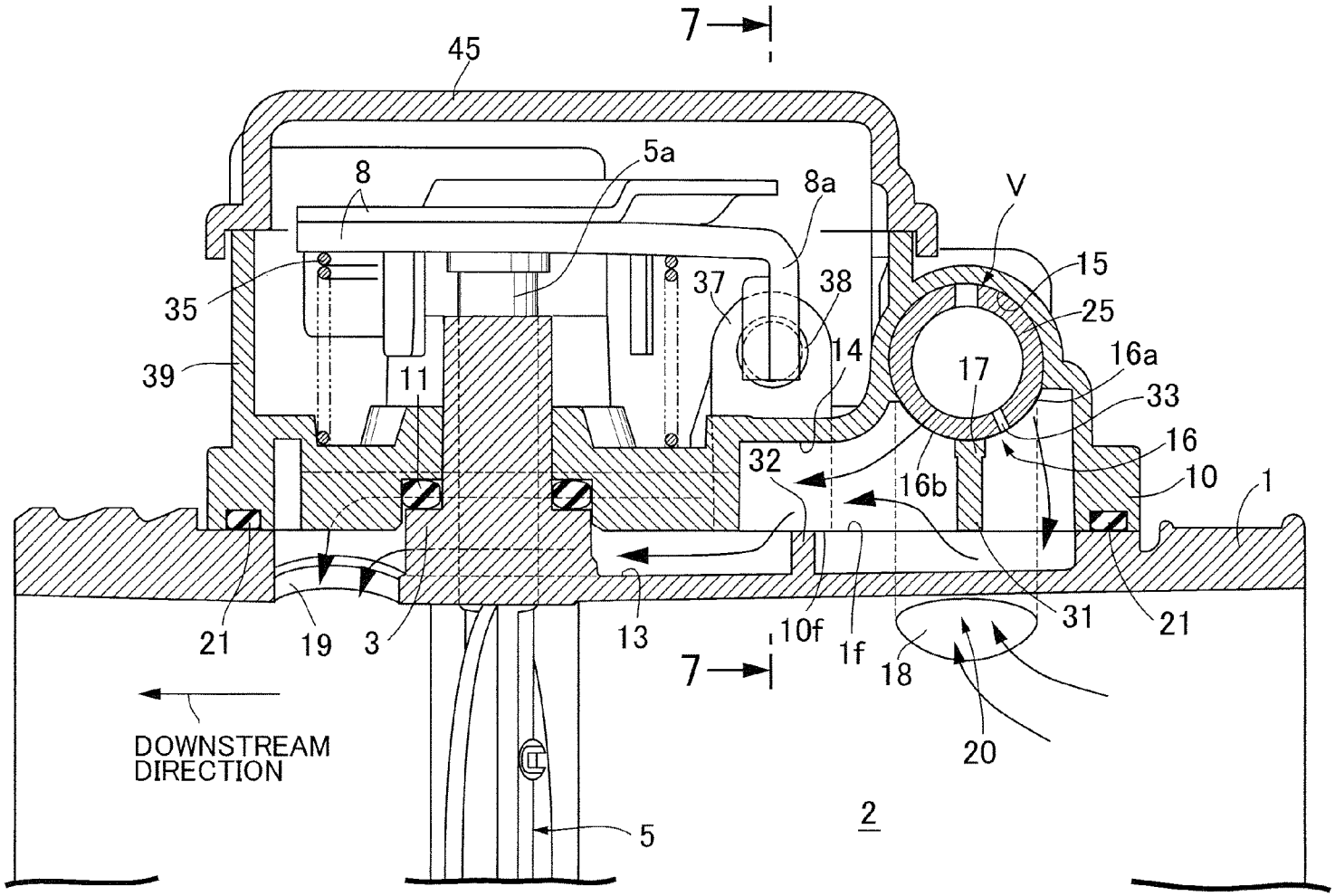
FIG. 3 is a sectional view along line 3-3 in FIG. 1 (first embodiment).

First, in FIG. 1 and FIG. 2, an air intake device for an engine of the present invention includes a throttle body 1 having a horizontal air intake path 2 communicating with an air intake port (not illustrated) of the engine. First and second bearing bosses 3 and 4 are formed in middle sections of opposing side walls of the throttle body 1 so as to project outward, a valve shaft 5*a* of a butterfly throttle valve 5 for opening and closing the air intake path 2 is rotatably supported by these bearing bosses 3 and 4, and the bearing bosses 3 and 4 are equipped with seals 6 and 7 respectively, which make intimate contact with the outer peripheral face of the valve shaft 5*a*. A throttle drum 8 is fixedly attached to one end portion of the valve shaft 5*a* projecting outward from the first bearing boss 3. Furthermore, a fuel injection valve 9 is mounted on an upper wall of the throttle body 1, the fuel injection valve 9 being capable of injecting fuel toward the air intake path 2 on the downstream side of the throttle valve 5.

As shown in FIG. 3 to FIG. 7, joined by a bolt to a side face of the throttle body 1 on the throttle drum 8 side is a bypass valve holder 10 extending around and fitted onto an outer periphery of the first bearing boss 3 via a seal 11, formed in a face 1*f* of the throttle body 1, opposing the bypass valve holder 10, is a groove-shaped first recess 13 surrounding the first bearing boss 3, and formed in a side face 10*f* of the bypass valve holder 10, opposing the throttle body 1, is a groove-shaped second recess 14 that passes above the first bearing boss 3 and is superimposed on an upper part of the first recess 13. Furthermore, formed in the bypass valve holder 10 are a vertically extending cylindrical valve chamber 15 and a metering hole 16 for providing communication between a vertically middle section of the valve chamber 15 and one end part of the second recess 14.

A lower end part of the valve chamber 15 communicates with the air intake path 2 on the upstream side of the throttle valve 5 via an inlet port 18 (see FIG. 1 and FIG. 4) formed from the throttle body 1 to the bypass valve holder 10. Furthermore, the other end part of the first recess 13 communicates with the air intake path 2 on the downstream side of the throttle valve 5 via an outlet port 19 (see FIG. 1, FIG. 3, and FIG. 5) formed from the throttle body 1 to the bypass valve holder 10. In this arrangement, the inlet port 18 and the outlet port 19 are disposed so that center lines thereof are parallel to the axis of the first bearing boss 3, 4. It is therefore possible to machine the throttle body 1 so as to coaxially form the inlet port 18, the outlet port 19, and a shaft hole of the first bearing boss 3, 4.

The inlet port 18, the valve chamber 15, the metering hole 16, the recesses 13 and 14, and the outlet port 19 thereby form a bypass 20 connected to the air intake path 2 while surrounding the first bearing boss 3 so as to bypass the throttle valve 5. A seal 21 is provided between the opposing faces 1*f* and 10*f* of the throttle body 1 and the bypass valve holder 10 so as to surround the recesses 13 and 14, the inlet port 18, and the outlet port 19.

Figure 4:
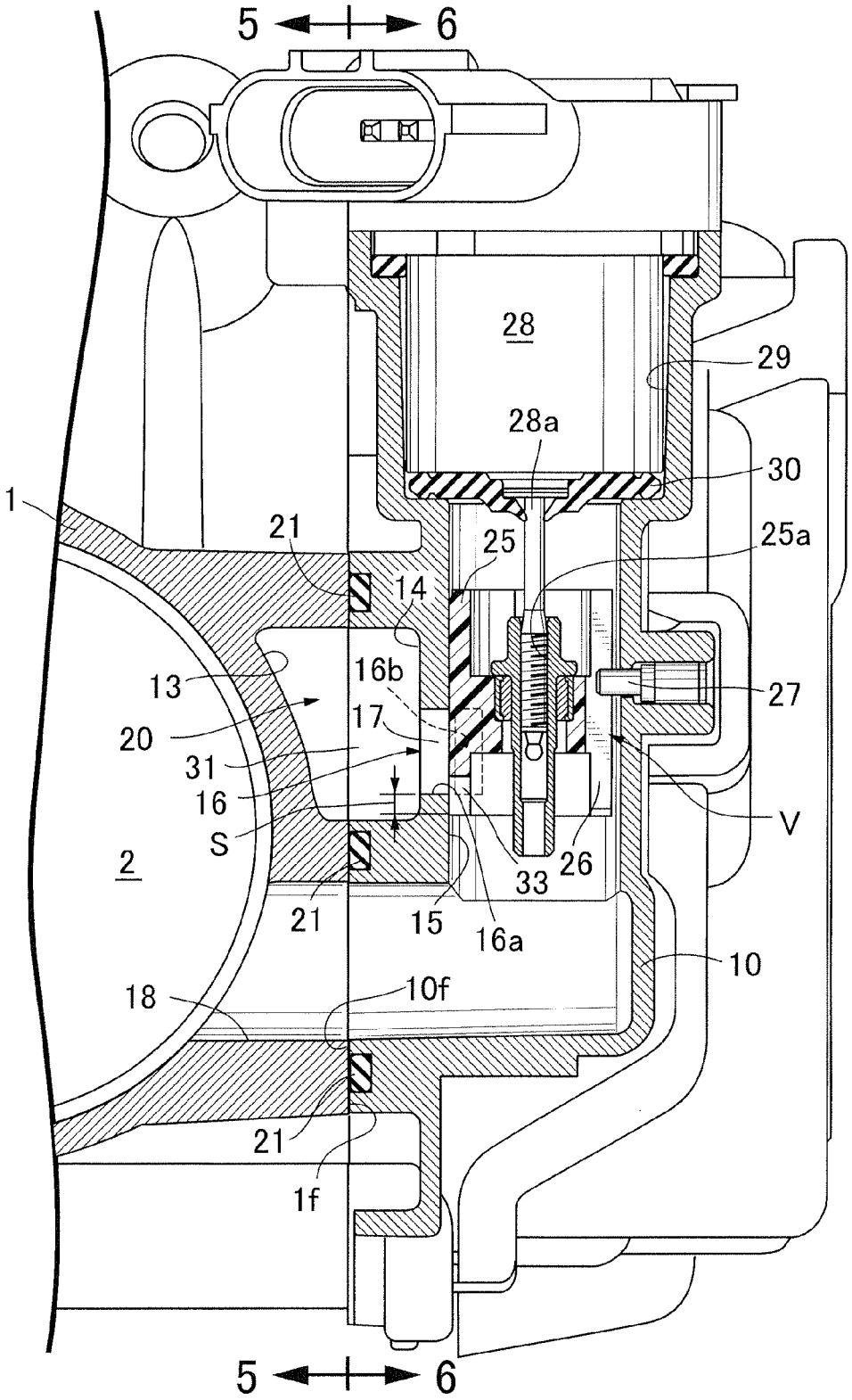
FIG. 4 is a sectional view along line 4-4 in FIG. 1 (first embodiment).
Figure 5:
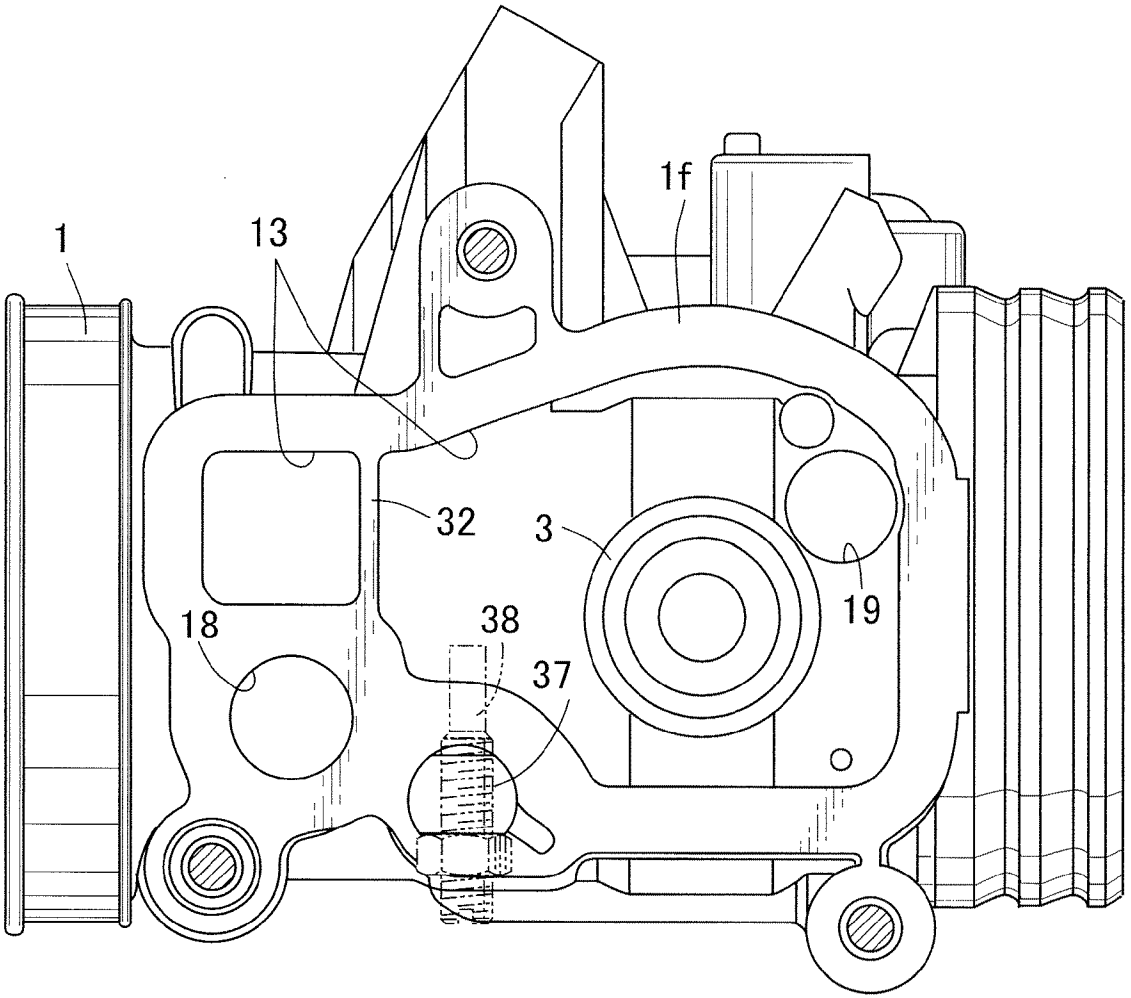
FIG. 5 is a sectional view along line 5-5 in FIG. 4 (first embodiment).
Figure 6:
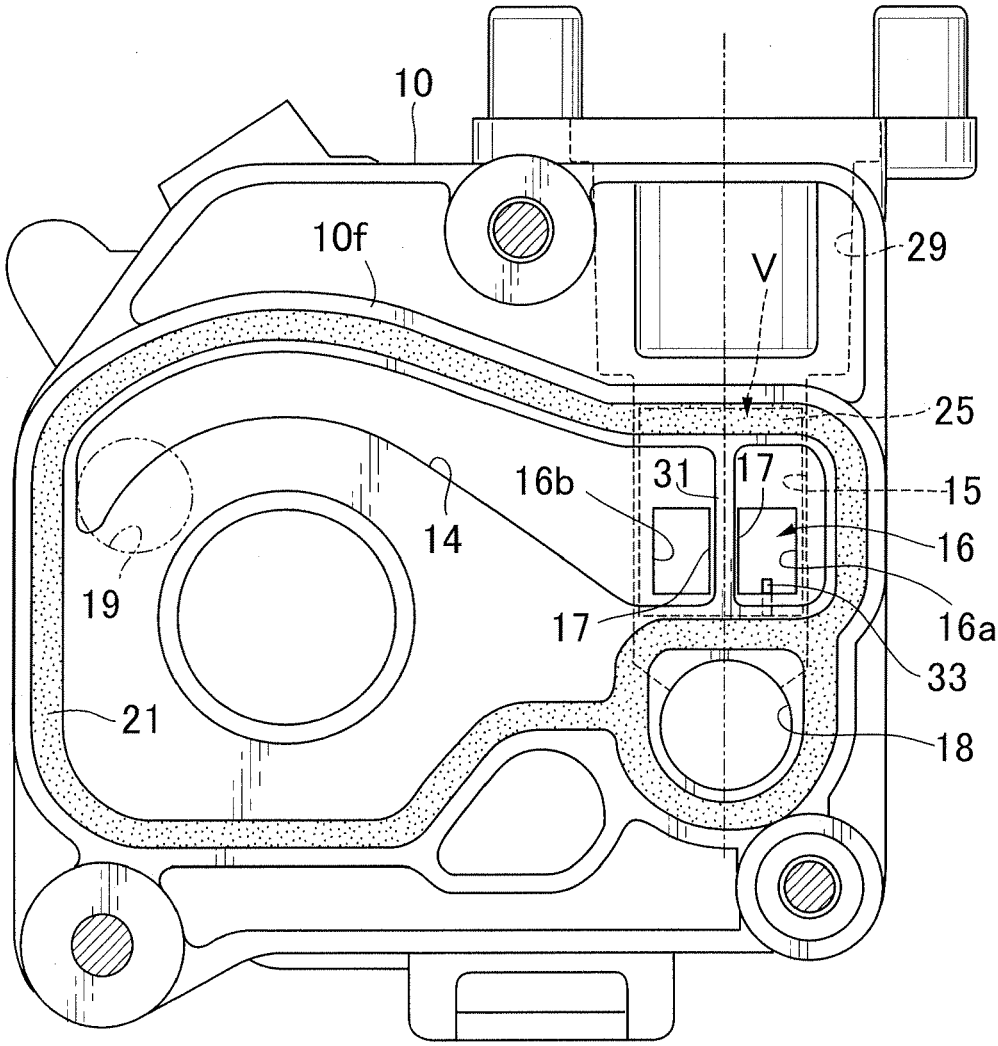
FIG. 6 is a sectional view along line 6-6 in FIG. 5 (first embodiment).
Figure 7:
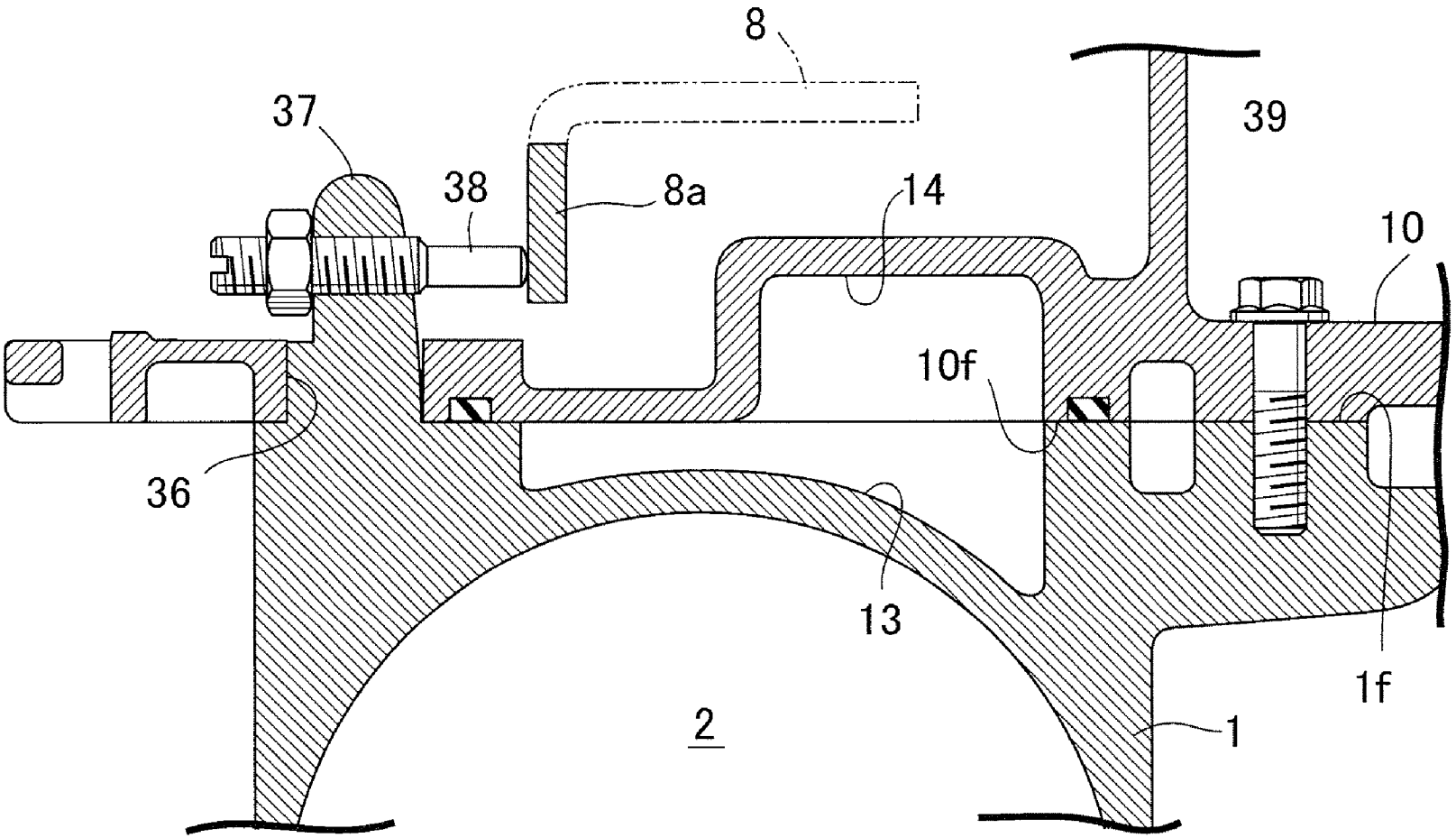
FIG. 7 is a sectional view along line 7-7 in FIG. 3 (first embodiment).

As clearly shown in FIG. 4, a piston-shaped valve body 25 for adjusting the degree of opening of the metering hole 16 from a fully closed state to a fully open state is slidably fitted into the valve chamber 15 from above, and in order to prevent the valve body 25 from rotating in this arrangement, a key 27 slidably engaging with a key groove 26 in the side face of the valve body 25 is mounted on the bypass valve holder 10. The valve chamber 15 and the valve body thereby form a bypass valve V.

Formed in the bypass valve holder 10 is a mounting hole 29 communicating with the upper end of the valve chamber 15, and mounted in this mounting hole 29 is an electric actuator 28 for moving the valve body 25 for opening and closing. This electric actuator 28 has a downwardly projecting output shaft 28*a* screwed into a screw hole 25*a* in a center part of the valve body 25, and rotating the output shaft 28*a* forward and backward enables the valve body 25 to move up and down (open and close). A plate-shaped seal 30 is provided between a lower end face of the electric actuator 28 and a base face of the mounting hole 29, the seal 30 making intimate contact with an outer peripheral face of the output shaft 28*a*.

As shown in FIG. 1, FIG. 3, FIG. 6, and FIG. 9, the metering hole 16 is divided by a dividing wall 17 into a plurality (two in the illustrated example) of small metering holes 16*a* and 16*b* arranged in the peripheral direction of the valve chamber 15, and the dividing wall 17 is formed integrally with the bypass valve holder 10 so as to be continuous with the inner peripheral face of the valve chamber 15. The small metering holes 16*a* and 16*b* each have two sides parallel to a sliding direction of the valve body 25.

As shown in FIG. 1, FIG. 3, FIG. 5, and FIG. 6, a plurality (two in the illustrated example) of labyrinth walls 31 and 32 are formed on the throttle body 1 and the bypass valve holder 10 in a section where the first and second recesses 13 and 14 are superimposed upon each other, the labyrinth walls 31 and 32 being arranged alternately along the direction of flow of air while traversing the recesses 13 and 14. In this arrangement, the first labyrinth wall 31 on the bypass valve holder 10 side is provided so as to be connected to the dividing wall 17 between the small metering holes 16*a* and 16*b*.

Figure 9:
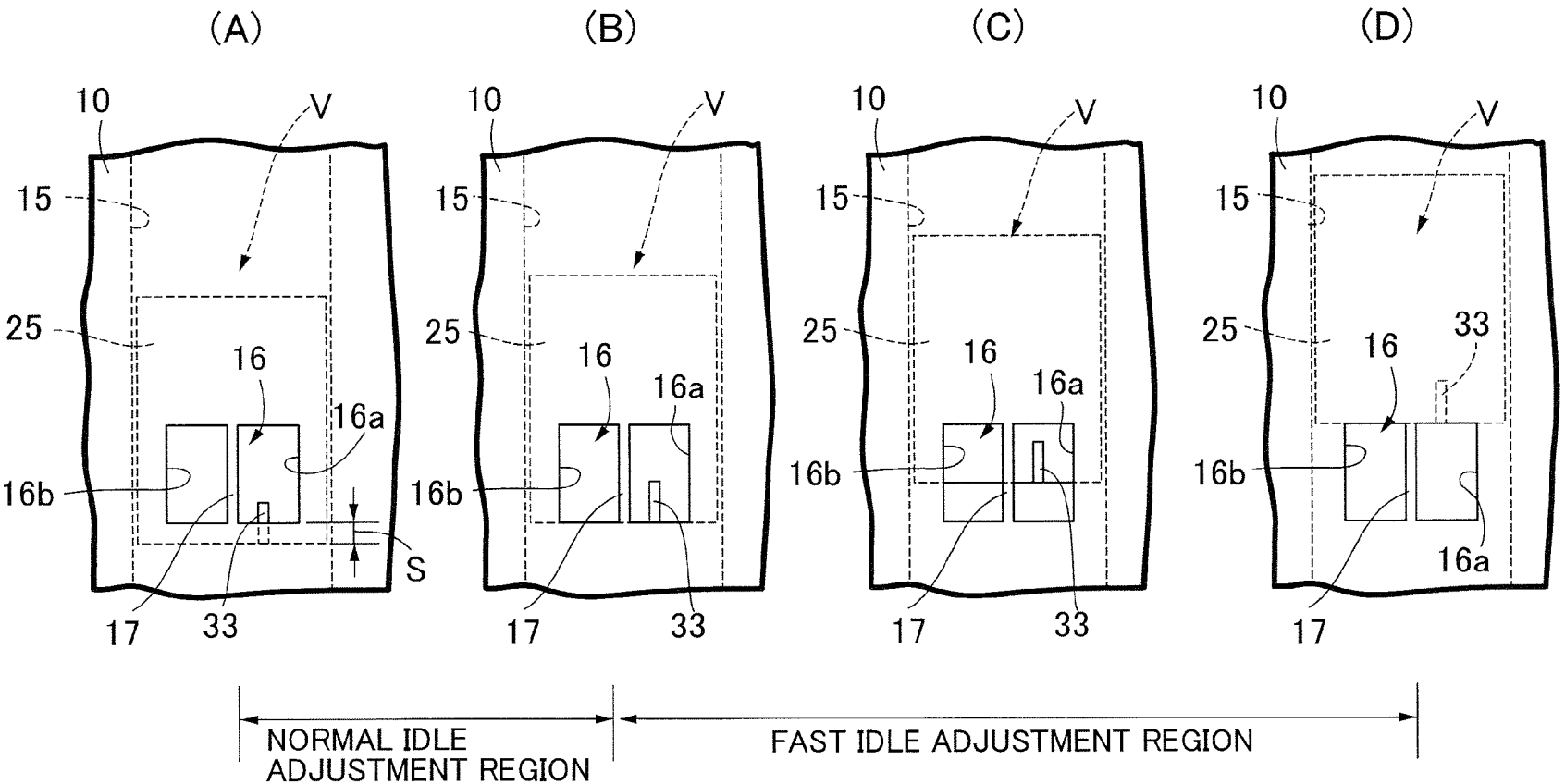
FIG. 9 is a front view for explaining the operation of a bypass valve (first embodiment).

The valve body 25 is given a normal idle adjustment stroke S for moving from a fully closed position (see FIG. 9 (A)) to a position at which the small metering holes 16*a* and 16*b* start to open (see FIG. 9 (B)). Furthermore, a slit 33 is formed in the valve body 25 in a section facing the small metering hole 16*a* that, among the plurality of small metering holes 16*a* and 16*b*, is at a position on the upstream side of the labyrinth wall 31 in the bypass 20 (that is, a position farther from the outlet port 19), the slit 33 extending in the axial direction of the valve body 25 and providing communication between the valve chamber 15 and the small metering hole 16*a*; this slit 33 is formed so that the area opening to the small metering hole 16*a* increases as the valve body 25 moves through the normal idle adjustment stroke S from the fully closed position.

Figure 8:
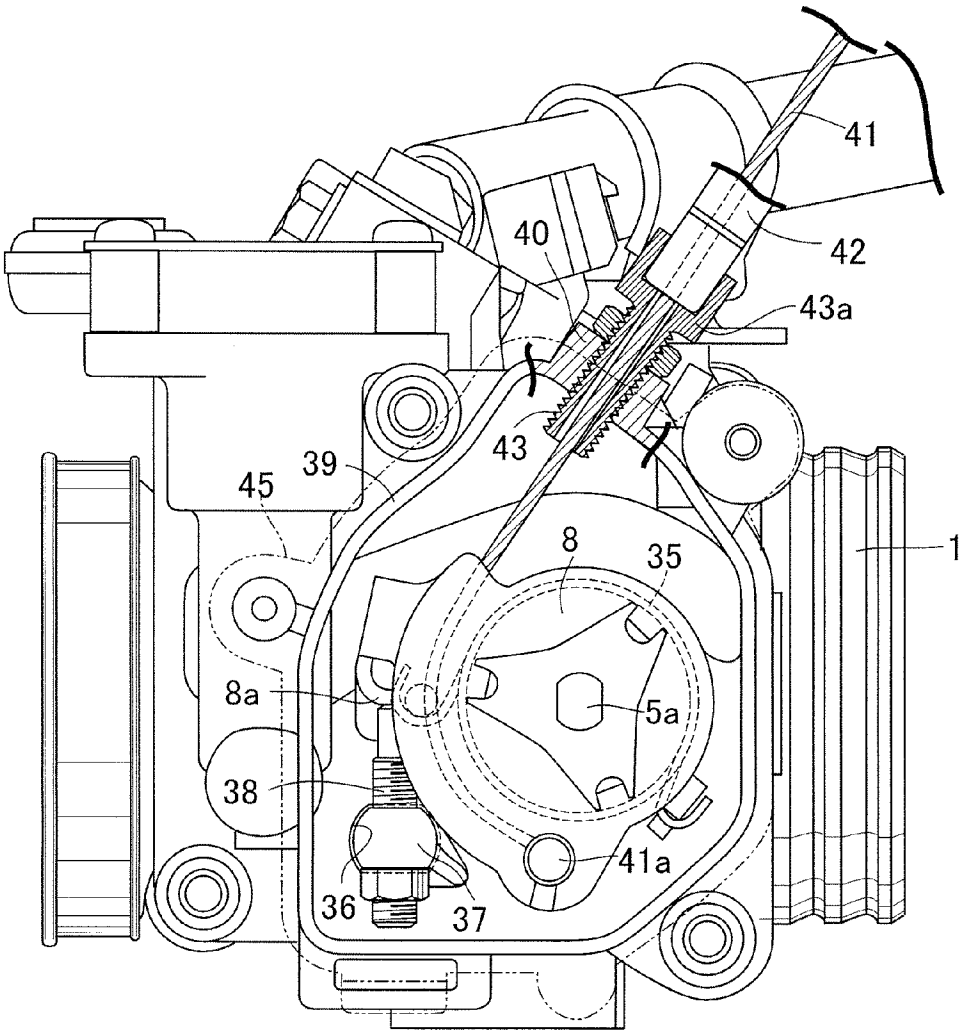
FIG. 8 is a view from arrow 8 in FIG. 2 (first embodiment).

In FIG. 2 and FIG. 8, a return spring 35, which is a torsion coil spring, urging the throttle drum 8 in a direction that closes the throttle valve 5 is mounted between the bypass valve holder 10 and the throttle drum 8 so as to surround the first bearing boss 3. Furthermore, a full closure regulation part 37 running through a through hole 36 of the bypass valve holder 10 and projecting toward the throttle drum 8 side is formed integrally with the throttle body 1, and a stopper bolt 38 adjustably screwed into a forward end part of the full closure regulation part 37 regulates a fully closed position of the throttle valve 5 by receiving a bent stopper piece 8*a* of the throttle drum 8.

Formed integrally with the bypass valve holder 10 is a tubular wall 39 surrounding the throttle drum 8 and being integrally equipped with a support boss 40 on one side, linked to the throttle drum 8 is a connection terminal 41*a* at one end of a throttle wire 41 running through the support boss 40, and linked to a throttle operation member such as a throttle grip (not illustrated) is a connection terminal at the other end of the throttle wire 41. A hollow bolt 43 through which the throttle wire 41 runs is adjustably screwed into the support boss 40, and an end part of a guide tube 42 slidably covering the throttle wire 41 is supported by a head portion 43*a* of the hollow bolt 43.

Pulling the throttle wire 41 by the throttle operation member enables the throttle valve 5 to be opened via the throttle drum 8, and releasing the pulling enables the throttle valve 5 to be closed by the urging force of the return spring 35.

A cover 45 for closing an open face of the tubular wall 39 is detachably retained on the tubular wall 39 by a screw.

Referring again to FIG. 2, a control block 50 covering an end face of the second bearing boss 4 is joined to the throttle body 1, and a throttle sensor 51 for detecting a degree of opening of the throttle valve 5 is formed between the control block 50 and the valve shaft 5*a*. Furthermore, provided in the control block 50 is a through hole 52 adjacent to the second bearing boss 4, and mounted on the control block 50 is a temperature sensor 53 running through the through hole 52 and having its forward end part facing the air intake path 2 on the upstream side of the throttle valve 5. Furthermore, mounted on the control block 50 is an electronic control unit 54 that receives detection signals from the throttle sensor 51, the temperature sensor 53, etc. and controls the operation of the electric actuator 28, the fuel injection valve 9, an ignition system, etc.

The operation of this embodiment is now explained.

When the engine is running, the electronic control unit 54 supplies to the electric actuator 28 a current corresponding to an air intake temperature detected by the temperature sensor 53, thus operating the electric actuator 25 and thereby controlling the opening and closing of the valve body 25. When the engine is at a low temperature, that is, the engine is warming up, the valve body 25 is pulled up by a large amount, thus controlling the degree of opening of the small metering holes 16*a* and 16*b* so that it is large (see FIGS. 9 (C) and (D)). When the throttle valve 5 is in a fully closed state, the amount of fast idle air that is supplied to the engine through the bypass 20, that is, in sequence through the inlet port 18, the valve chamber 15, the small metering holes 16*a* and 16*b*, the first and second recesses 13 and 14, and the outlet port 19, is controlled so as to be relatively large by the degree of opening of the small metering holes 16*a* and 16*b*; at the same time an amount of fuel corresponding to the air intake temperature is injected from the fuel injection valve 9 toward the downstream side of the air intake path 2, and the engine receives a supply of the fast idle air and the fuel, thus maintaining an appropriate fast idling rotational speed so as to accelerate the warming up.

When the engine temperature increases as warming up progresses, since the electric actuator 28 accordingly makes the valve body 25 descend, thus decreasing the degree of opening of the small metering holes 16*a* and 16*b*, the amount of fast idle air supplied to the engine through the bypass 20 decreases, and the engine fast idling rotational speed decreases. When the engine temperature attains a predetermined high temperature, since the electric actuator 28 makes the valve body 25 descend to a position at which it closes the small metering holes 16*a* and 16*b* (see FIG. 9 (A)), the engine completes warming up and moves to running with normal idling.

Since the small metering holes 16*a* and 16*b* have a rectangular shape, it is possible to control a large fast idle air volume by opening and closing the small metering holes 16*a* and 16*b* by the valve body 25 (see section b-c in FIG. 10), thus enabling a higher output for the engine to be matched.

Furthermore, since the dividing wall 17 continuous with the inner peripheral face of the valve chamber 15 is present between the plurality of small metering holes 16*a* and 16*b*, even when the valve body 25 is drawn toward the plurality of small metering holes due to engine air intake negative pressure, since the valve body 25 is supported by the dividing wall 17, it is possible to prevent the end part of the valve body 25 from being forced out toward the small metering holes 16*a* and 16*b*, thereby guaranteeing a smooth opening and closing movement of the valve body 25. This enables the small metering holes 16*a* and 16*b* to be set sufficiently large and a large fast idle air volume to be controlled, thus enabling a higher output for the engine to be matched.

Figure 10:
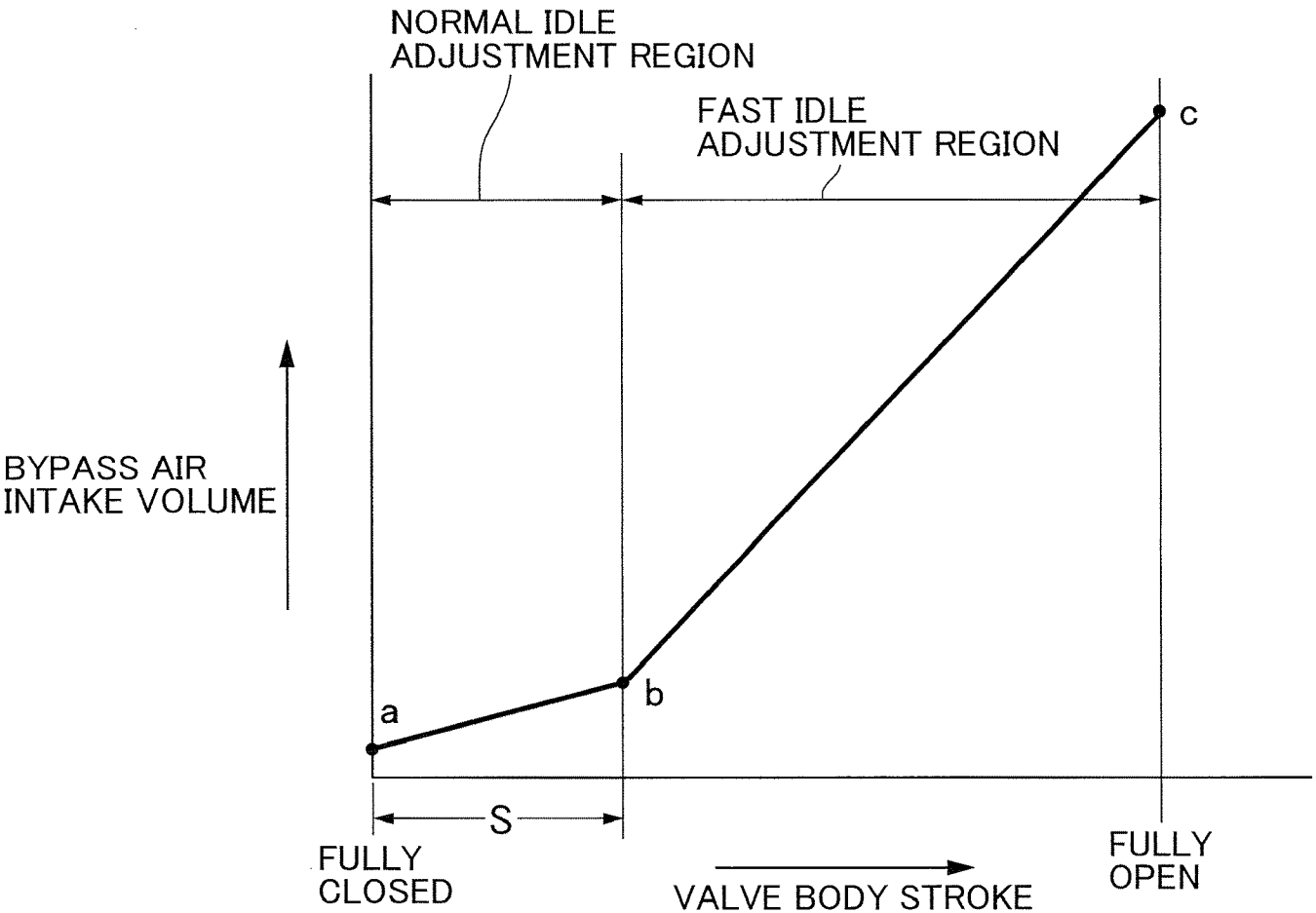
FIG. 10 is a diagram of the bypass valve characteristics (first embodiment).

When the valve body 25 subsequently closes the small metering holes 16*a* and 16*b* and enters a normal idle adjustment stroke S as shown in FIGS. 9 (A) and (B), since only the slit 33 of the valve body 25 provides communication between the valve chamber 15 and the metering hole 16*a*, the engine normal idle air intake volume is determined by the area of the slit 33 opening to the small metering hole 16*a*, and it is possible to easily carry out fine adjustment of the normal idle air volume by up and down movement of the valve body 25 within the normal idle adjustment stroke S (see section a-b in FIG. 10).

Since the bypass 20 is formed so as to surround the first bearing boss 3, which supports the end part of the valve shaft 5*a* on the throttle drum 8 side, the space around the outer periphery of the first bearing boss 3, which is conventionally considered to be dead space, is utilized effectively for formation of the bypass 20, and it is therefore possible to make the overall air intake device compact while preventing the dimensions of the area around the throttle sensor 51 on the side opposite to the throttle drum 8 from increasing.

Furthermore, since at least one part of the bypass 20 is formed from the groove-shaped recesses 13 and 14 formed in opposing faces of the throttle body 1 and the bypass valve holder 10, which are joined to each other, even if the shape of the bypass 20 is complicated, at least one part thereof can be formed easily at the same time as molding the throttle body 1 and the bypass valve holder 10.

Moreover, since the center lines of the inlet port 18 and outlet port 19 of the bypass 20, which open on the air intake path 2, are parallel to the axis of the valve shaft 5*a*, it is possible to machine the throttle body 1 so as to coaxially form the inlet port 18 and the outlet port 19 and the shaft hole of the bearing boss, thereby contributing to a reduction in the number of machining steps.

Furthermore, since, in order to form the bypass 20, a plurality of labyrinth walls 31 and 32 are provided on the groove-shaped recesses 13 and 14 formed in the two opposing faces 1*f* and 10*f* of the throttle body 1 and the bypass valve holder 10, the labyrinth walls 31 and 32 being arranged alternately along the direction of flow of air while traversing the recesses 13 and 14, it is possible to simply form a labyrinth in the bypass 20, and even when the engine blows back and the blown back gas flows backward in the bypass 20, carbon contained in the gas can be trapped in the labyrinth and thus prevented from entering the small metering holes 16*a* and 16*b*. In particular, since one of the labyrinth walls 31 is provided so as to be connected to the dividing wall 17 between the small metering holes 16*a* and 16*b*, and the small metering hole 16*a* in which the slit 33 of the valve body 25 opens is positioned on the upstream side of the dividing wall 17 in the bypass 20, it is possible to prevent effectively the carbon described above from entering the slit 33. It is therefore possible to prevent the slit 33 from being blocked by carbon, thereby stabilizing the adjusted normal idle air volume.

Furthermore, since the full closure regulation part 37 running through the bypass valve holder 10 and projecting toward the throttle drum 8 side is formed integrally with the throttle body 1, and the fully closed position of the throttle valve 5 is regulated by means of the stopper bolt 38, which is screwed into the full closure regulation part 37, receiving the stopper piece 8*a* of the throttle drum 8, even if the bypass valve holder 10 is displaced relative to the throttle body 1 to some degree, the fully closed position of the throttle valve 5 can always be reproduced accurately regardless of the displacement.

Moreover, since the tubular wall 39 covering the outer periphery of the throttle drum 8 is formed integrally with the bypass valve holder 10, and the cover 45 is mounted on the open end of the tubular wall 39 so as to block it, the throttle drum 8 and the area around the shaft end of the valve shaft are covered in a substantially hermetically sealed manner by the tubular wall 39 of the bypass valve holder 10 and the cover 45, thus providing protection against dust and water therefor and, moreover, since the tubular wall 39 is formed on the bypass valve holder 10, it is possible to suppress any increase in the number of components and simplify the structure.

Furthermore, since the support boss 40 supporting the guide tube 42 of the throttle wire 41 is formed integrally with the tubular wall 39, the tubular wall 39, that is, the bypass valve holder 10, functions also as a support member for supporting the end part of the guide tube 42 of the throttle wire 41, thus reducing the number of components and the number of assembly steps.

An embodiment of the present invention is explained above, but the present invention is not limited thereto and may be modified in a variety of ways as long as the modifications do not depart from the spirit and scope of the present invention. For example, the present invention may be applied to a downdraft type throttle body having its air intake path standing vertically. Furthermore, the bypass valve holder 10 may be formed integrally with the throttle body 1.

The invention claimed is:

1. An air intake device for an engine, comprising a throttle body (1) having an air intake path (2), a throttle valve (5) that is supported on the throttle body (1) and that opens and closes the air intake path (2), a bypass (20) connected to the air intake path (2) while bypassing the throttle valve (5), and a bypass valve (V) for controlling the degree of opening of the bypass (20), the bypass valve (V) being formed from a tubular valve chamber (15) having an interior thereof opening on the upstream side of the bypass (20) and having an inner face with a metering hole (16) opening toward the downstream side of the bypass (20), and a valve body (25) that is slidably but non-rotatably fitted into the valve chamber (15) and that opens and closes the metering hole (16), at least part of the downstream side of the bypass (20) extending from the metering hole (16) being formed so as to cross a sliding direction of the valve body (25), characterized in that the bypass (20) is a single bypass, the tubular valve chamber (15) and the metering hole (16) and at least of the downstream side of the bypass (20) are formed in a bypass valve holder (10) provided so as to be connected to the throttle body (1), and a dividing wall (17) that divides the metering hole (16) into a plurality of small metering holes (16*a*, 16*b*) arranged in the peripheral direction of the valve chamber (15) is formed in the bypass valve holder (10) so as to be continuous with an inner peripheral face of the valve chamber (15), and the plurality of small metering holes (16*a*, 16*b*) communicate with a single passage (14, 13) forming the downstream side of the bypass (20).

2. The air intake device for an engine according to claim 1, wherein the small metering holes (16*a*, 16*b*) are each formed as a rectangle having two sides parallel to a sliding direction of the valve body (25).

3. The air intake device for an engine according to claim 1 or 2, wherein the valve body (25) is given a normal idle adjustment stroke (S) for moving from a fully closed position thereof to a position at which the small metering holes (16*a*, 16*b*) start to open, the valve body (25) is provided with a slit (33) for providing communication between the valve chamber (15) and at least one of the small metering holes (16*a*), and the slit (33) is formed so that the area of the slit (33) opening to the small metering hole (16*a*) increases as the valve body (25) moves through the normal idle adjustment stroke (S) from the fully closed position.

4. The air intake device for an engine according to claim 3, wherein the small metering hole (16*a*) in which the slit (33) opens is positioned on the upstream side, relative to the other small metering hole (16*b*), of the bypass (20), and a labyrinth wall (31) is provided so as to be connected to the dividing wall (17), the labyrinth wall (31) trapping carbon flowing backward in the bypass (20) and preventing carbon from entering the small metering hole (16*a*) in which the slit (33) opens.

* * * * *